US008133453B2

(12) United States Patent
Molitor

(10) Patent No.: US 8,133,453 B2
(45) Date of Patent: Mar. 13, 2012

(54) PLUNGER STROKE PIPETTE

(75) Inventor: Peter Molitor, Henstedt-Ulzburg (DE)

(73) Assignee: Eppendorf AG, Hamburg (DE)

( * ) Notice: Subject to any disclaimer, the term of this patent is extended or adjusted under 35 U.S.C. 154(b) by 868 days.

(21) Appl. No.: 11/443,728

(22) Filed: May 31, 2006

(65) Prior Publication Data

US 2007/0014696 A1 Jan. 18, 2007

(30) Foreign Application Priority Data

Jul. 16, 2005 (DE) ..... 10 2005 033 378

(51) Int. Cl.
*B01L 3/02* (2006.01)

(52) U.S. Cl. .... 422/501; 73/863.32; 73/864; 73/864.01; 73/864.16; 73/864.18; 422/500; 422/921; 422/925

(58) Field of Classification Search ..... 422/100, 422/500–501, 921, 925; 73/863.32, 864, 73/864.01, 864.16, 864.18
See application file for complete search history.

(56) References Cited

U.S. PATENT DOCUMENTS

| | | | | | |
|---|---|---|---|---|---|
| 3,855,867 | A | * | 12/1974 | Roach | 73/864.18 |
| 3,882,729 | A | * | 5/1975 | Roach | 73/864.18 |
| 4,020,698 | A | | 5/1977 | D'Autry | 73/425.6 |
| 4,096,750 | A | * | 6/1978 | Sturm | 73/864.18 |
| 4,096,751 | A | * | 6/1978 | Withers et al. | 73/864.18 |
| 4,133,211 | A | * | 1/1979 | Sarstedt | 73/864.17 |
| 4,144,761 | A | * | 3/1979 | Dzaack | 73/864.18 |
| 4,165,646 | A | * | 8/1979 | Shapiro | 73/864.13 |
| 4,229,413 | A | * | 10/1980 | Marteau d'Autry | 422/100 |
| 4,250,755 | A | * | 2/1981 | Kenney | 73/864.13 |
| 4,257,267 | A | * | 3/1981 | Parsons | 73/864.14 |
| 4,283,950 | A | * | 8/1981 | Tervamaki | 73/864.14 |
| 4,284,604 | A | * | 8/1981 | Tervamaki | 422/100 |
| 4,298,575 | A | * | 11/1981 | Berglund | 73/864.13 |
| 4,567,780 | A | * | 2/1986 | Oppenlander et al. | 73/864.16 |
| 4,763,535 | A | * | 8/1988 | Rainin et al. | 73/864.18 |
| 4,779,467 | A | * | 10/1988 | Rainin et al. | 73/864.17 |
| 4,784,834 | A | * | 11/1988 | Hirschmann | 422/100 |
| 4,790,176 | A | * | 12/1988 | Marteau d'Autry | 73/1.74 |
| 4,905,226 | A | * | 2/1990 | Kobayashi | 370/378 |
| 4,909,991 | A | * | 3/1990 | Oshikubo | 422/100 |
| 4,929,428 | A | * | 5/1990 | Tezuka | 422/100 |
| 5,012,682 | A | * | 5/1991 | Sabloewski | 73/864.18 |
| 5,104,624 | A | * | 4/1992 | Labriola | 422/100 |
| 5,320,810 | A | * | 6/1994 | Al-Mahareeq et al. | 422/100 |

(Continued)

FOREIGN PATENT DOCUMENTS

DE 43 35 863 C1 2/1995

*Primary Examiner* — Brian R Gordon
(74) *Attorney, Agent, or Firm* — Vidas, Arrett & Steinkraus, P.A.

(57) ABSTRACT

A plunger stroke pipette for replaceable pipette points with a seat for the detachable mounting of a pipette point, a plunger, a cylinder in which the plunger is movably arranged, a connection channel connecting the cylinder with an opening in the seat, a driving equipment, coupled to the plunger for displacing the plunger in the cylinder, an upper stopper and a lower stopper and at least one counter-stopper of the driving equipment and/or the plunger for limiting the stroke of the plunger, a holder, holding the lower stopper, an overstroke spring between the upper stopper and the holder, an adjustment equipment for adjusting the position of the holder with respect to the cylinder, and an indicating equipment for indicating the position of the holder.

21 Claims, 4 Drawing Sheets

U.S. PATENT DOCUMENTS 5,364,596 A * 11/1994 Magnussen et al. ..... 422/100
5,389,341 A * 2/1995 Tuunanen et al. ..... 422/100
5,413,006 A * 5/1995 D'Autry ..... 73/864.18
5,531,131 A * 7/1996 Sabloewski ..... 73/864.18
5,650,124 A * 7/1997 Gilson ..... 422/180
5,672,320 A * 9/1997 Ritter ..... 422/100
5,700,959 A * 12/1997 Homberg ..... 73/864.16
5,747,709 A * 5/1998 Oshikubo ..... 73/864.18
5,770,159 A * 6/1998 Marteau D'Autry ..... 422/100
5,792,424 A * 8/1998 Homberg et al. ..... 422/100
5,849,248 A * 12/1998 Homberg ..... 422/100
6,295,880 B1 * 10/2001 Gilson ..... 73/864.18
6,352,673 B1 * 3/2002 Rainin et al. ..... 422/100
6,365,110 B1 * 4/2002 Rainin et al. ..... 422/100
6,428,750 B1 * 8/2002 Rainin et al. ..... 422/100
6,645,433 B2 * 11/2003 Homberg et al. ..... 422/100
6,923,938 B2 * 8/2005 Cote et al. ..... 422/100
7,146,867 B2 * 12/2006 Jagdhuber ..... 73/863.32
7,175,813 B2 * 2/2007 Petrek et al. ..... 422/100
7,204,163 B2 * 4/2007 Uldry et al. ..... 73/864.18
7,284,454 B2 * 10/2007 Cote ..... 73/864.18
7,416,704 B2 * 8/2008 Scordato et al. ..... 422/100
2002/0081234 A1 * 6/2002 Homberg et al. ..... 422/100
2003/0099578 A1 * 5/2003 Cote et al. ..... 422/100
2005/0039550 A1 * 2/2005 Uldry et al. ..... 73/864.18
2005/0158214 A1 * 7/2005 Cote et al. ..... 422/100
2005/0247141 A1 * 11/2005 Belgardt et al. ..... 73/864.01
2005/0262951 A1 * 12/2005 Cote ..... 73/864

* cited by examiner

PLUNGER STROKE PIPETTE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention is related to a plunger stroke pipette for replaceable pipette points.

Plunger stroke pipettes serve for dosing liquids. They take up a certain volume of a sample liquid in a pipette point. As a disposable article, the pipette point is normally realised from plastic material. After one dosing, the pipette point can be replaced through a new pipette point. Thus, contamination of the plunger stroke pipette and carry-over of sample liquid is avoided.

For the aspiration of sample liquid into and the ejection of sample liquid from the pipette point, the plunger stroke pipette has a cylinder with a plunger, which is shiftable therein. Via a connection channel, the cylinder is connected with openings in a seat for detachable mounting of a pipette point. The plunger is coupled to a driving equipment, which serves for the displacement of the plunger in the cylinder. The plunger is shiftable in the cylinder between an upper and a lower stopper. Upon displacement, the plunger moves an air column, through which liquid is aspirated into the pipette point or ejected from it, respectively. In the beginning of the aspiration of air into the cylinder, the counter-stopper is situated on the lower stopper. In the beginning of the displacement of air from the cylinder, the counter-stopper fits closely to the upper stopper. The amount of liquid which is taken up or discharged, respectively, depends of the stroke of the plunger.

The stroke volume of the plunger does not exactly correspond to the amount of liquid which is taken up and discharged. As the air column lengthens somewhat through the weight of the liquid, the stroke volume exceeds the liquid volume. In particular, the difference between stroke volume and liquid volume depends from the density and the viscosity of the liquid, the temperature, the air pressure and from wetting effects. It is known to adjust the position of the upper stopper for the calibration of plunger stroke pipettes to a certain dosing volume.

In fixed volume pipettes, the distance between upper and lower stopper is constant. A fixed volume pipette with an upper stopper in the form of a threaded sleeve which is adjustable by means of a calibration tool is known from U.S. Pat. No. 4,020,698, the entire contents of which is hereby incorporated by reference in its entirety. The sleeve-like calibration part has a scale on its outer side, which is visible from the outside through a transparent reading window.

In plunger stroke pipettes with adjustable dosing volume, the position of the upper stopper is changeable. Adjustable plunger stroke pipettes have an adjustable spindle for changing the position of the upper stopper. The difference of the stroke volume from the dosing volume can be different in the adjustment range of dosable liquid volumina. Plunger stroke pipettes are known in which the indicating equipments can be uncoupled from the adjustment equipments for the upper stopper for the purpose of calibration. DE 43 35 863 C1 (the entire contents of which is hereby incorporated by reference in its entirety) discloses such a plunger stroke pipette with uncouplable gearwheels between indicating equipments and adjustment equipments. In order to uncouple, a control lever which projects to the outside through an opening of the pipette casing has to be actuated.

In the known plunger stroke pipettes, a manufacturer's calibration is performed by the pipette manufacturer under standard conditions. In this, bi-distilled water of a temperature of 20 to 25° C. and an air pressure of 1013 mbar is used. If the user wants to pipette at conditions different from these, (an other liquid than bi-distilled water, e.g.), he has to change the manufacturer's calibration. The change of the manufacturer's calibration mostly necessitates sumptuous use of tools. Finding the manufacturer's calibration again necessitates sumptuous gravimetric measurements.

Departing from this, the present invention is based on the objective to provide a plunger stroke pipette which facilitates change of manufacturer's calibration and finding manufacturer's calibration again for the user.

Advantageous embodiments of the plunger stroke pipette are indicated in the subclaims.

BRIEF SUMMARY OF THE INVENTION

The plunger stroke pipette for replaceable pipette points according to the present invention comprises a seat for the detachable mounting of a pipette point, a plunger, a cylinder, in which the plunger is movably arranged, a connection channel, connecting the cylinder with an opening in the seat, a driving equipment, coupled to the plunger for displacing the plunger in the cylinder, an upper stopper and a lower stopper and at least one counter-stopper of the driving equipment and/or the plunger for limiting the stroke of the plunger, a holder, holding the lower stopper, an overstroke spring between the upper stopper and the holder, an adjustment equipment for adjusting the position of the holder with respect to the cylinder, and an indicating equipment for indicating the position of the holder.

In the plunger stroke pipette according to the invention, the user can perform a calibration, when a liquid is to be dosed which has another density or viscosity than the liquid upon which the manufacturer's calibration is based, or when it is to be operated at a different temperature or air pressure, for instance. This user's calibration is performed by only shifting the lower stopper. Thus, the position adjustment of the upper stopper performed at the manufacturer's calibration is not changed. The indicating equipment shows the respective position of the holder which holds the stopper. Thus, the position of the lower stopper which it took at the manufacturer's calibration can be found again at any time. This makes it possible for the user to find the manufacturer's calibration again without sumptuous gravimetric measurement and without additional tools. By doing so, the plunger stroke pipette corresponds again to the condition at the distribution with respect to calibration. The adjustment equipment for adjusting the position of the holder, and with this also of the lower stopper, can be realised such that it can be operated easily and without the use of tools. As a consequence, the calibration by the user can be performed in a particularly simple manner. Embodiments in which the upper stopper is definitively set at a time by the manufacturer as well as embodiments which have an adjustable upper stopper which enables subsequent correction of the manufacturer's calibration are included. Examination and correction of the manufacturer's calibration can optionally be performed in a conventional manner by setting the position of the upper stopper.

According to one embodiment, the pipette has a pull-back spring, which charges the plunger or the driving equipment in the direction of the abutment of the counter-stopper on the upper stopper. Through this, the plunger is brought into a defined initial position, departing from which a dosing operation can be begun. This embodiment is particularly advantageous with manually operated plunger stroke pipettes, which have a manually operatable driving equipment. In electronic pipettes, which have an electric driving equipment, the initial positioning takes place by an electronic control, so that a pull-back spring can be omitted. The present invention is related to manually operated and to electronic plunger stroke pipettes as well.

According to one embodiment, the driving equipment comprises a lifting rod, displaceable in a guiding, which is connected or couplable with the plunger at the one end and which is connected with an operation button on the other end. This embodiment is related to manually operatable plunger stroke pipettes in particular. The lifting rod is connected with the plunger, e.g. by being realised in one piece with it or screwed on at it or by being otherwise fixedly connected with it. In another embodiment, it can be coupled with the plunger by closely fitting to a front side of the plunger and being kept in abutment by the pull-back spring. This is particularly advantageous in plunger stroke pipettes with an upper part comprising the driving equipment and a lower part, comprising the cylinder and the plunger and being detachable from the former. In an electronic pipette, for instance, the plunger is movable by a motor-driven spindle.

According to one embodiment, the counter-stopper is a bead on the perimeter of the lifting rod. The bead can circulate completely or partially on the perimeter of the lifting rod.

According to one embodiment, the lower stopper is disc-shaped and the lifting rod is guided through a central clearance hole of the lower stopper. The part of the lifting rod which is guided through is connected with the plunger or couplable with it. According to a further embodiment, the lower stopper is dome shaped on the side facing the counter-stopper. According to a further embodiment, which assists the centering of the lifting rod or the stopper, the lower stopper has a sleeve shaped joined piece on the side opposite to the counter-stopper, through which the clearance hole runs through.

According to a further embodiment, the holder has the form of a pot which has a central bottom hole in the bottom, through which the lifting rod is guided through, the lower stopper is shiftably arranged in the holder, the holder has a brim on its opening, projecting towards the inside and overlapping the stopper, and the overstroke spring is arranged in the holder and props up on the bottom at the one end and on the lower side of the stopper at the other end. Thus, lower stopper, overstroke spring and holder can be advantageously integrated into one single assembly part.

The lower stopper props up on the holder via an overstroke spring, in order to perform an overstroke for blowing off residual liquid from the pipette point when liquid is discharged from the pipette point. The user or the control electronics of an electronic pipette, respectively, recognises the reaching of the lower stopper by the increased resistance at the beginning of the deformation of the overstroke spring. Before the aspiration of liquid into the pipette point, the driving equipment is only operated so far until the counter-stopper reaches the lower stopper. Upon ejection of the liquid from the pipette point, the counter-stopper is pressed against the lower stopper by means of the driving equipment, so that the overstroke spring deflects and residual liquid is ejected from the pipette point.

According to one embodiment, the overstroke spring and/or the pull-back spring is/are a helical spring.

According to one embodiment, the adjustment equipments have an outside thread on the holder and an interior thread, co-operating therewith and being stationary with respect to the cylinder. Outside thread and interior thread serve as adjustment threads for the positioning of the holder with respect to the cylinder. This embodiment is particularly advantageous in the realisation of the holder in the form of a pot.

In principle, it is possible to adjust the position of the lower stopper by screwing of the holder in the adjustment thread. For example, after opening a casing of the plunger stroke pipette, the holder is screwed manually or with the aid of a tool, respectively, in order to do this.

According to one embodiment, the adjustment equipments have an actuating drive, co-operating with the holder. The actuating drive facilitates the adjustment of the upper stopper, optionally without opening the pipette casing.

According to one embodiment, the actuating drive has a calibration lever, connected with the holder, and/or an actuating gear, coupled with the holder. By means of a calibration lever or an actuating gear, respectively, a holder is screwable in an interior thread, for instance. The calibration lever can be manually operated, for instance. According to one embodiment, the calibration lever is the pointer of the indicating equipment at the same time, and a scale of the indicating equipment, stationary with respect to the cylinder, is assigned to the swivelling range of the calibration lever. For example, the calibration lever is guided out of a casing of the plunger stroke pipette through a slit, so that it can be operated from the outside. According to a further embodiment, the calibration lever bears a curved screen on the end side, which covers a slit in a casing which is stationary with respect to the cylinder, to which a scale on the outer perimeter of the casing is assigned. The screen prevents dirt from penetrating into the casing through the slit.

The actuating gear can be realised in different ways. In principle, all the kinds of gears come into consideration, gearwheel gears in particular. According to one embodiment, the actuating gear has a driven gearwheel on the perimeter of the holder and a driving gearwheel, engaging therewith and being manually operatable. According to a further embodiment, the driving gearwheel of the actuating gear has an operation section, projecting out of a casing, or is assigned to a casing opening, through which it is operatable from the outside. According to a further embodiment, the holder has a scale of the indicating equipment on its envelope, to which a mark of the indicating equipment is assigned, which is stationary with respect to the cylinder. According to a further embodiment, the scale is visible through a casing opening of a casing which has a mark on the casing opening or which permits only the set scale value to be seen from the outside.

According to one embodiment, the actuating gear is a spur wheel gear and/or a conical wheel gear.

The invention is related to fixed volume pipettes as well as to plunger stroke pipettes with adjustable dosing volume. According to one embodiment, a plunger stroke pipette with adjustable dosing volume has a spindle, screwable in a spindle nut which is stationary with respect to the cylinder, the lower front side of which forms the upper stopper, which has a passage channel through which the lifting rod is guided through and in which the spindle is rotationally coupled with a volume adjustment equipment.

The adjustment of the volume can be realised in different ways. In principle, it is possible to readjust the spindle manually and to provide it with a manually-operated actuation element for this purpose, for instance. According to one embodiment, the volume adjustment equipment has an adjustment sleeve, accommodating coaxially the spindle and being rotatably mounted, which has axial grooves in the inside into which a driving tenon engages which is splinedly connected with the spindle. According to a further embodiment, the adjustment sleeve is coupled with a numerator for indicating the volume adjustment via a gear.

According to a further embodiment, there is an equipment for uncoupling of two gear elements of the gear between adjustment sleeve and numerator. When the gear is uncoupled, the upper stopper is shiftable by operating the adjustment sleeve, in order to perform a manufacturer's calibration. After setting the upper stopper, adjustment sleeve and numerator are coupled again. According to one embodiment, the gear has a set of gearwheels, which engages with a gearwheel on the perimeter of the adjustment sleeve and with a gearwheel on the initial roller of the numerator and is shiftable along an axis by means of the equipment for uncoupling, at least one gearwheel being uncoupled in doing so. This embodiment results in minimizing the numerator jump, i.e. the shifting of the numerator which takes place upon coupling in because of the overlap of the gearwheels of driving sleeve and numerator. Through this, calibration errors are minimized.

According to a further embodiment, plunger, seat, cylinder, connection channel, driving equipment, stoppers, holder, overstroke spring, adjustment equipment and indicating equipment are arranged in or on a casing.

According to a further embodiment, the pipette is a hand-held pipette.

Finally, the pipette is a manually operated pipette according to one embodiment.

BRIEF DESCRIPTION OF THE SEVERAL VIEWS OF THE DRAWINGS

In the following, the present invention is explained in more detail by means of the attached drawings of examples of realisation. In the drawings show.

DETAILED DESCRIPTION OF THE INVENTION

Figure 2:
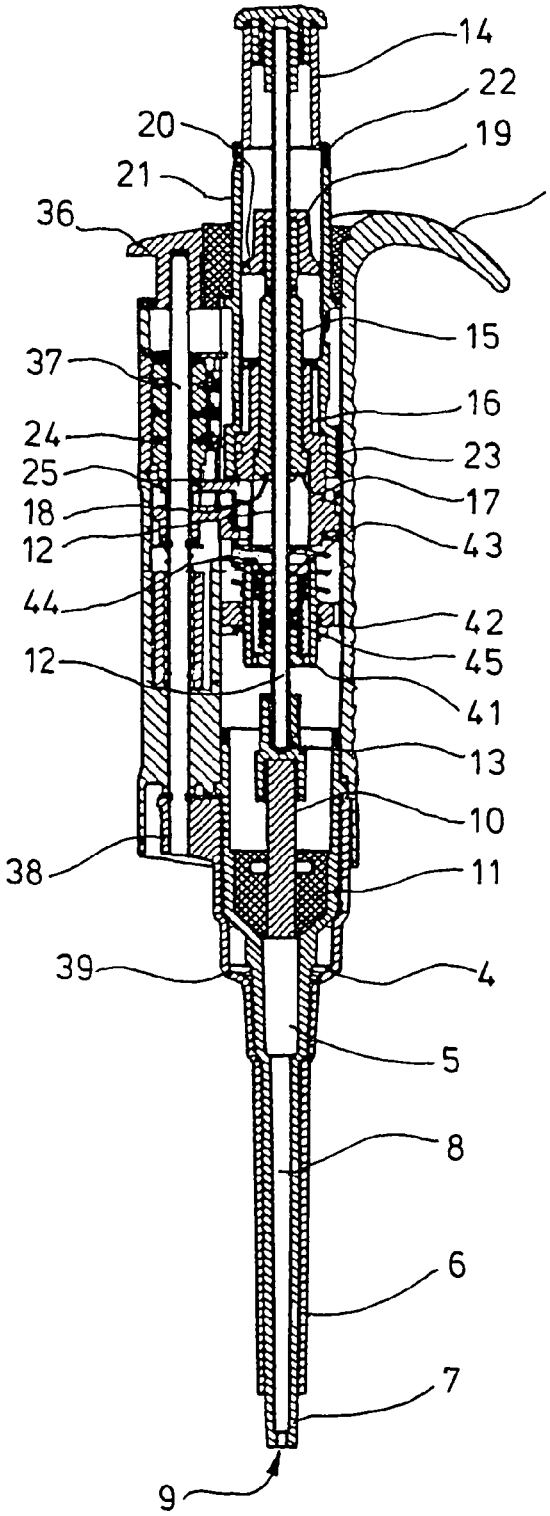
FIG. 2 the same hand-held pipette after the manufacturer's calibration has been performed, in a longitudinal section.
Figure 3:
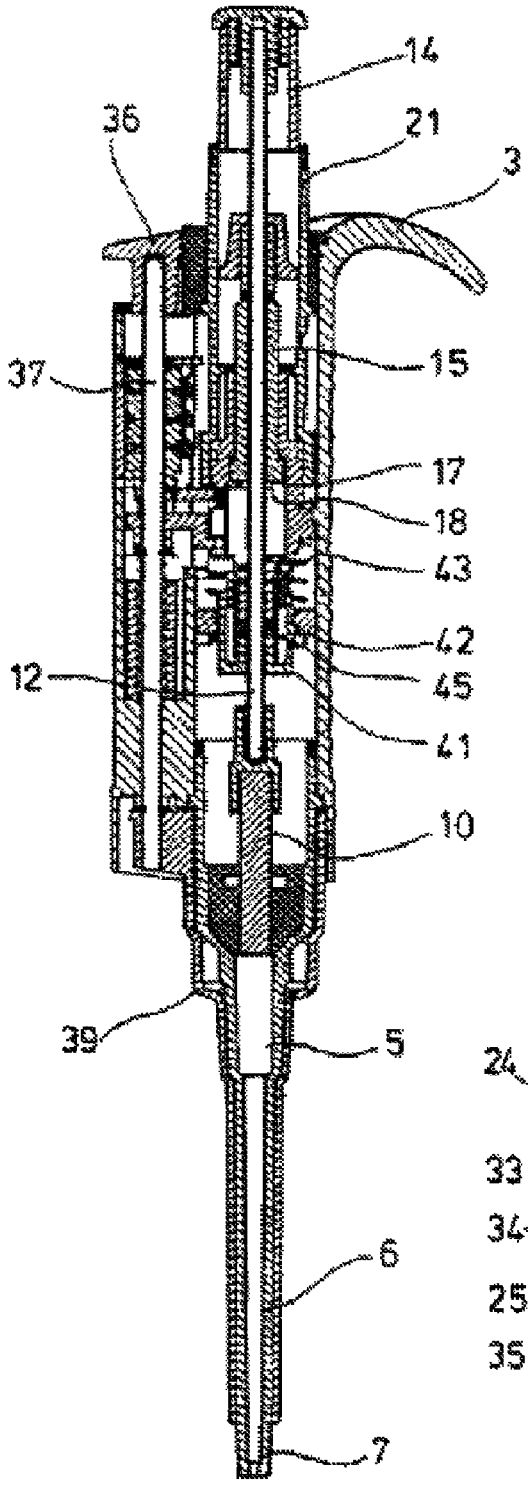
FIG. 3 the same hand-held pipette after the user's calibration has been performed, in a longitudinal section.

While this invention may be embodied in many different forms, there are described in detail herein a specific preferred embodiment of the invention. This description is an exemplification of the principles of the invention and is not intended to limit the invention to the particular embodiment illustrated According to FIG. 1 to 3, a pipette 1 according to the invention has a casing 2 with an upper part 3 of the casing and a lower part 4 of the casing.

The lower part 4 of the casing comprises a cylinder 5 and a slightly conical joined piece 6, which has a seat 7 for putting up a pipette point on its end. The cylinder 5 is connected with an opening 9 in the centre of the seat 7 via a connection channel 8.

Further, the lower part 4 of the casing comprises a plunger 10, which is guided into the cylinder 5 via a sealing system 11.

The upper part 3 of the casing contains a lifting rod 12, the lower end of which is connected with the plunger 10 via a coupling 13. On the upside, the lifting rod 12 bears an operation button 14.

The lifting rod 12 is guided trough a spindle 15, which is arranged in the upper part 3 of the casing. On the exterior, the spindle 15 has an external thread, which is screwable into an interior thread of a lifting body 16, which is fixed in the upper part 3 of the casing. Thus, the lifting body 16 forms a spindle nut.

The lower front side of the spindle 15 forms an upper stopper 17 for an annular bead 18 on the perimeter of the lifting rod 12.

On its upper end, the spindle 15 is splinedly connected with a driving tenon 19. By means of radially projecting ribs 20, the driving tenon 19 engages into axial grooves of an adjustment sleeve 21. The adjustment sleeve 21 is arranged concentric to the spindle 15 and is rotatably mounted between lifting body 16 and upper part 3 of the casing. With an upper operation end having a fluting 22 on its perimeter on the topside, the adjustment sleeve 21 projects out from the upper part 3 of the casing.

At the bottom, the adjustment sleeve has a gearwheel 23 on its perimeter. Further, there is a numerator 24 with an additional gearwheel 25 on an initial roller. The little number gearwheels of the numerator 25 are visible from the exterior of the upper part 3 of the casing through a window 26, which has a transparent cover 27.

Figure 4:
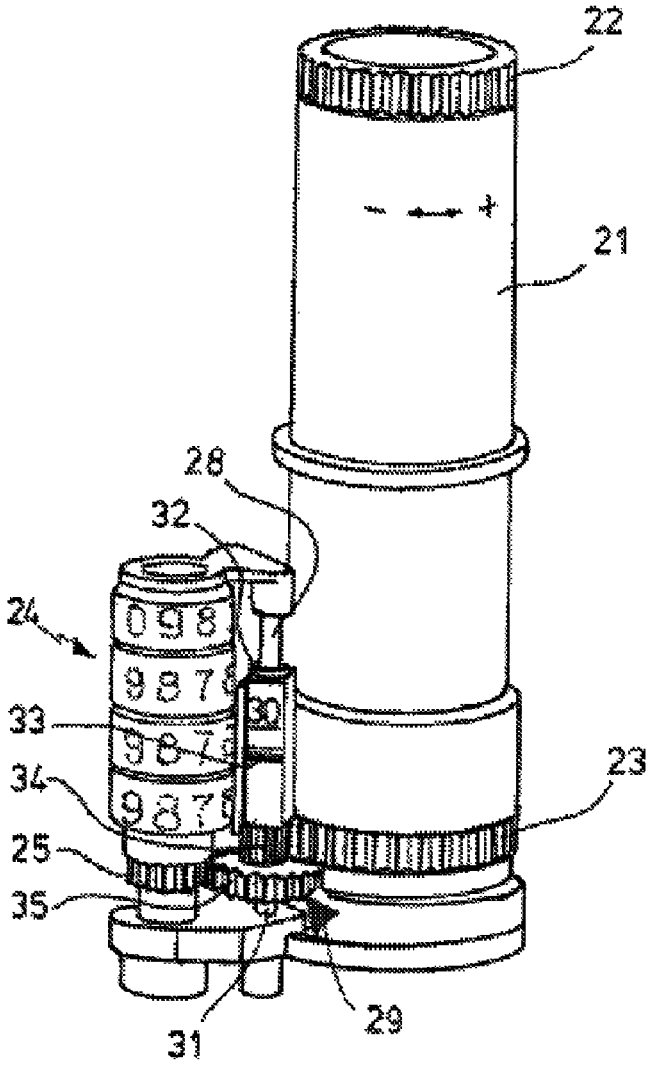
FIG. 4 adjustment sleeve and numerator with the gear coupling the same, in a perspective side view.
Figure 5:
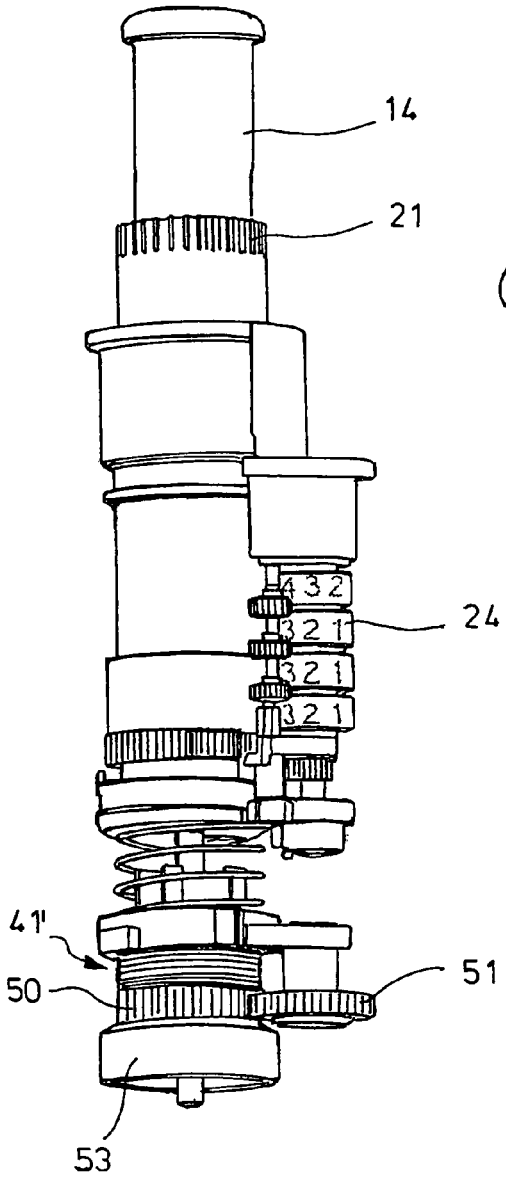
FIG. 5 the overstroke system with a front wheel gear, in a perspective side view.

In FIG. 4, details of the coupling of the adjustment sleeve 21 with the numerator 24 are shown. According to this, a set of gearwheels 29 is mounted on an axis 28. The set of gearwheels 29 is connected with an adjustment trunk 30, which is shiftable on the axis 28. A helical spring 31, guided on the axis 28, presses against the set of gearwheels 29, so that the set of gearwheels 29 presses the adjustment trunk 30 against a ring 32, which seats on the axis 28.

By inserting the blade of a screwdriver into a notch 33 on the outer side of the adjustment trunk 30 and dislocating against the action of the helical spring 31, the set of gearwheels 29 with its gearwheels 34, 35 can be lifted off from the gearwheel 23 of the adjustment sleeve 21 and the gearwheel 25 on the initial roller of the numerator 24.

In the upper edge region of the upper part 3 of the casing, a throwing off button 36 seats on a throwing off rod 37 alongside the adjustment sleeve 21. The throwing off rod 37 runs parallel to the lifting rod 12 through the upper part 3 of the casing. Its lower end is connected with a lateral joined piece 38 of a throwing off sleeve 39, which is movably arranged on the conical joined piece 6.

The upper part 3 of the casing has a window 40, through which the notch 33 of the adjustment trunk 30 can be accessed from the outside.

Below the lifting body 16, a pot shaped holder 41 is arranged in the upper part 3 of the casing. The holder has 41 has an external thread, which is screwably arranged in an interior thread of a support 42, which is fixed with respect to the casing.

The holder 41 contains a disc shaped lower stopper 43, which is held below an upper edge 44 of the holder 41, which is bent towards the inside. An overstroke spring 45, which props up on the bottom of the holder 41, presses the lower stopper 43 against the edge 44.

The lifting rod 12 is guided through central passages of the lower stopper 43, through the overstroke spring 45 and a central passage in the bottom of the holder 41.

A radially projecting calibration lever 46 is connected with the perimeter of the holder 41, which stands out from the upper part 3 of the casing through a slit 47. The calibration lever 46 is laterally connected with a screen 48, which prevents dust from penetrating into the slit 47 from the outside. On one side of the slit, the upper part 3 of the casing has a scale 49 to which the calibration lever 46 is assigned in the manner of a pointer.

The plunger 10 is movable in the cylinder 5 by pressing down the operation button 14 against the action of a pull-back spring, the stroke of the plunger being defined by the distance of the upper stopper 17 from the lower stopper 43, between which the counter stopper 18 is movable. When the counter stopper 18 reaches the lower stopper 43, an overstroke is possible in addition, until the overstroke spring 45 runs "on the trunk".

For the manufacturer's calibration, the calibration lever 46 is set on the catching zero point of the scale 49. The manufacturer's calibration is performed when the numerator 24 is uncoupled from the adjustment sleeve 21. In doing so, the numerator 24 is readjusted until its indication corresponds to the set dosing volume. This first possibility of calibration serves for the permanent calibration ex works and in the servicing case.

The second possibility of calibration serves for the temporary recalibration of the pipette to different media and environmental conditions (density, vapour pressure, temperature and so on). For this purpose, the overstroke system is shifted by actuation of the calibration lever 46. When the holder 41 is lifted, this means a reduction of volume. When it is lowered, the dosing volume is increased. If the user wants to return to the manufacturer's calibration from the calibration which he has performed himself, he only has to rotate back the calibration lever into its caught initial position.

Figure 1:
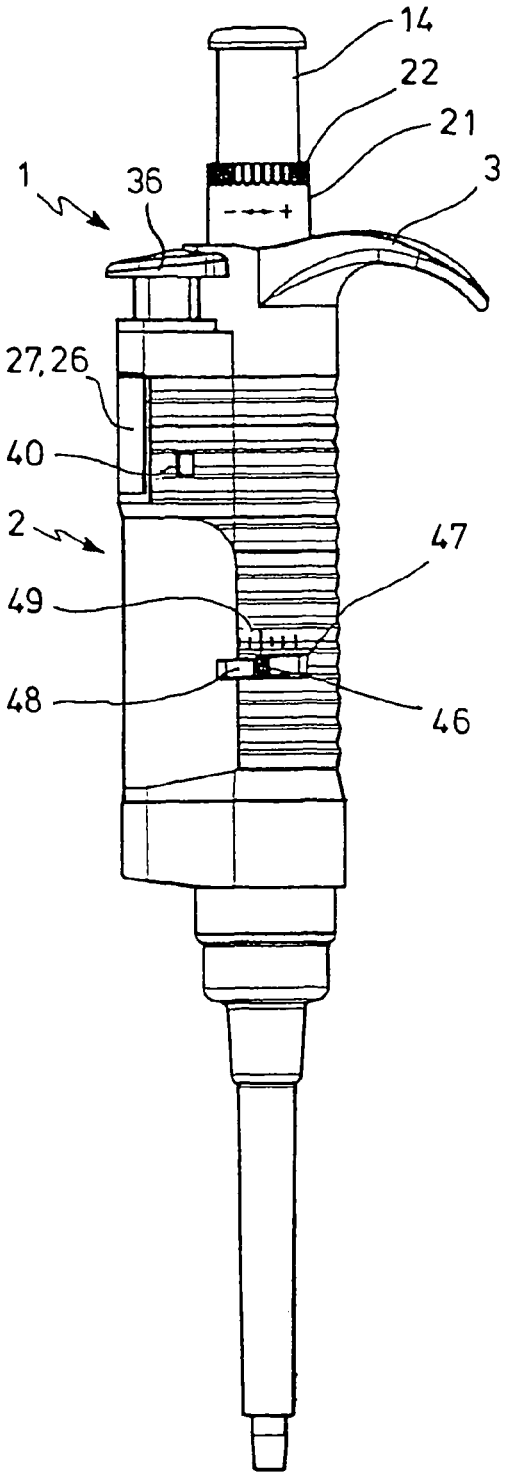
FIG. 1 a manually operated hand-held pipette in a side view.
Figure 6:
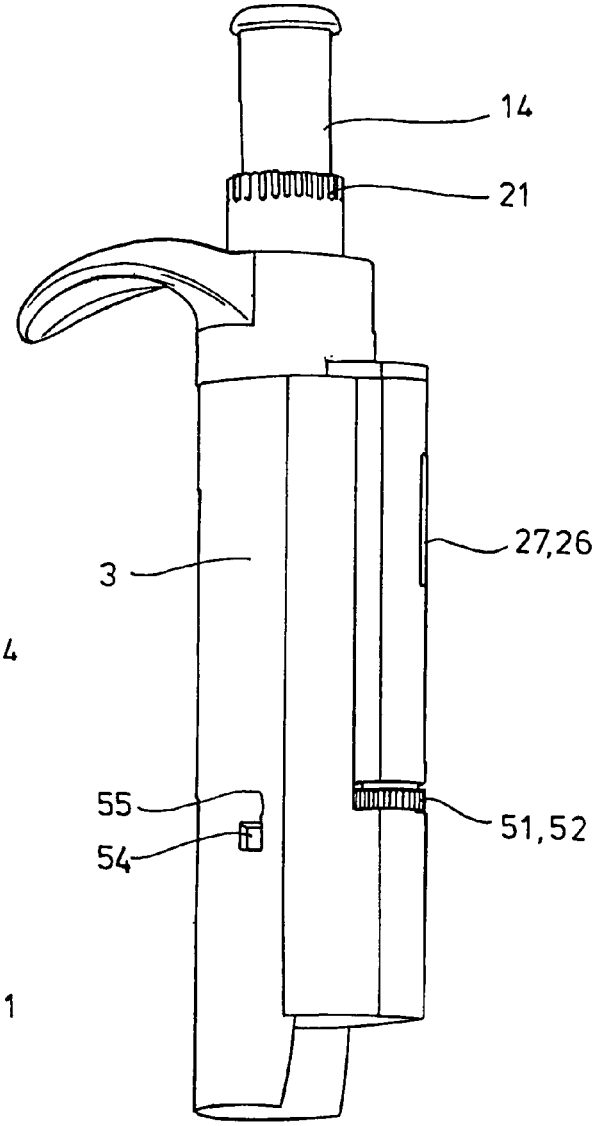
FIG. 6 the upper part of a casing of a plunger stroke pipette with an overstroke system according to FIG. 5, in a perspective side view.

In the following, further actuating gears for screwing on the holder in the casing are shown:

According to FIG. 1, a driven gearwheel 50 sits on the perimeter of the holder 41', which is rotationally fixed with the same by axial grooves on its inner perimeter and by radially projecting ribs on the outer perimeter of the holder 41'. The driven gearwheel 50 engages with a driving gearwheel 51, which is operatable from the outside through a further slit 52 of the upper part 3 of the casing according to FIG. 6. The holder 41' is screwed into the support 42 in the upper part 3 of the casing. On the perimeter, it has a scale 53, which is visible through a casing opening 54 of the upper part 3 of the casing. There it is possible to read the scale 53 on a mark 55 on the outer side of the upper part 3 of the casing.

Figure 7:
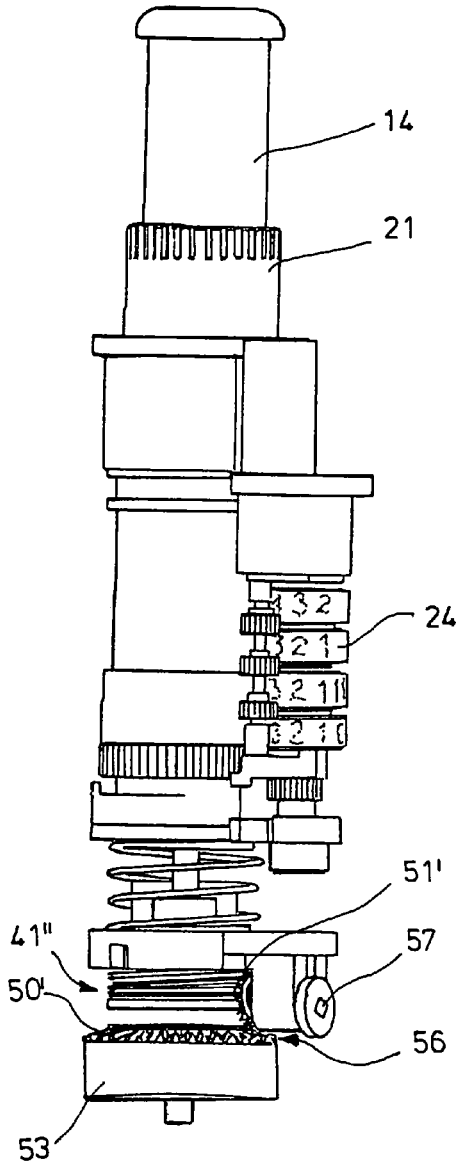
FIG. 7 the overstroke system with a conical wheel gear, in a perspective side view.
Figure 8:
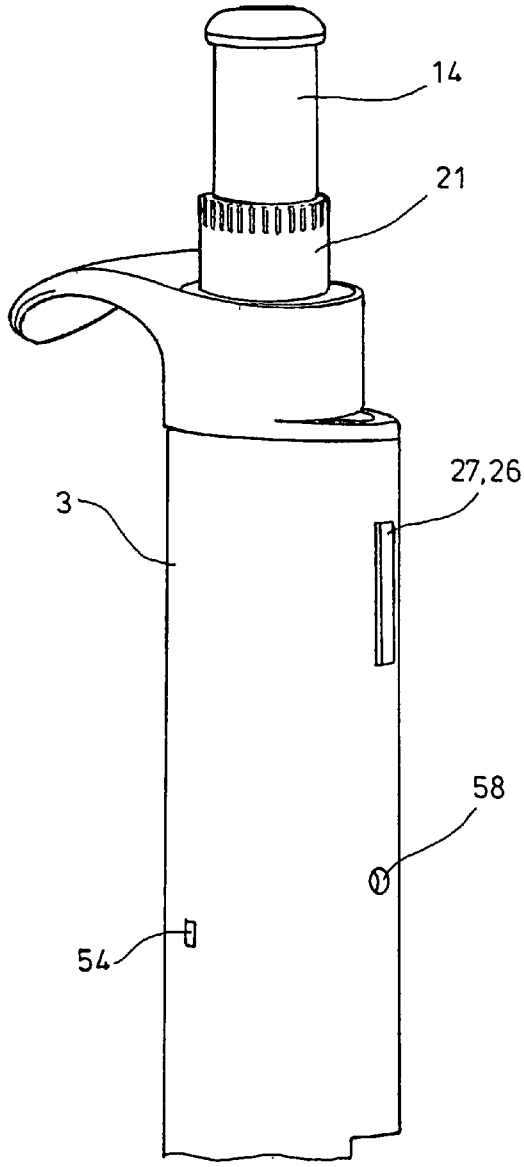
FIG. 8 the upper part of a casing of a plunger stroke pipette with an overstroke system according to FIG. 7, in a perspective side view.

According to FIG. 7, the driven gearwheel 50' of the holder 41" is a part of a conical wheel gear 56. The driving gearwheel 52' of the conical wheel gear 56 is connected with a joined part 57 for a tool. According to FIG. 8, the same is operatable from the outside by inserting a tool through an additional casing opening 58 in the upper part 3 of the casing. Even in this embodiment, the setting of the user's calibration can be read by observing a scale 53 on the perimeter of the holder 50' through an opening in the casingtr5.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed:

1. A plunger stroke pipette for replaceable pipette points comprising:

a seat for the detachable mounting of a pipette point, the seat having a first end including an opening;

a cylinder;

a connecting channel abutting the cylinder and connecting the cylinder to the opening in the seat;

a driving equipment;

the driving equipment comprising a lifting rod;

a plunger for providing a volumetric stroke, the plunger having proximal and distal ends;

the driving equipment coupled to the plunger for displacing the plunger in the cylinder;

an upper stopper;

a lower stopper;

the lifting rod comprising at least one counter-stopper for limiting the stroke of the plunger;

a holder, supporting the lower stopper wherein an overstroke spring is sandwiched between the holder and the upper stopper;

an adjustment equipment for adjusting the position of the holder with respect to the cylinder;

an indicating equipment for indicating the position of the holder;

a spindle;

a spindle nut;

the spindle connected in the spindle nut;

wherein a lower front side of the spindle forms the upper stopper, that is stationary with respect to the cylinder;

wherein the spindle has a passage channel through which the lifting rod is guided through;

a volume adjustment equipment;

wherein the spindle is rotationally coupled with the volume adjustment equipment;

the volume adjustment equipment comprises an adjustment sleeve accommodating coaxially the spindle, the adjustment sleeve having a gearwheel (23);

a driving tenon which is connected with the spindle;

the volume adjustment sleeve has axial grooves in an inside into which the driving tenon engages;

a numerator, the numerator having a gearwheel;

a set of gearwheels comprising two gearwheels;

a gear comprising the gearwheel of the numerator, the two gearwheels of the set of gearwheels and the gearwheel of the adjustment sleeve;

the adjustment sleeve is coupled with the numerator for indicating the volume adjustment via the set of gearwheels (29);

an equipment for uncoupling at least two of the gearwheels comprising the gear, between the adjustment sleeve and the numerator;

wherein one of the gearwheels of the set of gearwheels engages with the gearwheel of the adjustment sleeve and the other of the gearwheels of the set of gearwheels engages with the gearwheel of the numerator;

wherein each gearwheel of the set of gearwheels are mounted on an axis and are shiftable along their axis by means of the equipment for uncoupling, whereby at least one of the gearwheels of the adjustment sleeve and the numerator being uncoupled from one the gearwheels of the set of gearwheels.

2. The pipette according to claim 1, further comprising an operation button, wherein the lifting rod is coupled with the distal end of the plunger and the proximal end of the plunger is connected to the operation button.

3. The pipette according to claim 2, wherein the counter-stopper is a bead on a perimeter of the lifting rod.

4. The pipette according to claim 2, wherein the lower stopper, comprising first and second surfaces, the first surface being disc-shaped and the lifting rod is guided through a central clearance hole in the lower stopper.

5. The pipette according to claim 4, wherein the lower stopper's first surface faces the counter-stopper.

6. The pipette according to claim 4, wherein the lower stopper's second surface has a sleeve shaped shoulder facing the overstroke spring, the central clearance hole extending through the sleeve shaped shoulder.

7. The pipette according to claim 4, wherein the holder is pot shaped, the holder having a central bottom hole through which the lifting rod is guided, the lower stopper is shiftably arranged in the holder, the holder having a brim projecting towards an inside of the holder and overlapping the lower stopper, and the overstroke spring being arranged in the holder and supporting the holder on a first edge and the lower stopper on a second edge.

8. The pipette according to claim 1, wherein the overstroke spring is a helical spring.

9. The pipette according to claim 1, further including a support (42), wherein the volume adjustment equipment has an outside thread on the holder which is screwed to an interior thread of support (42).

10. The pipette according to claim 1, wherein the volume adjustment equipment has an actuating drive operatively arranged with respect to the holder.

11. The pipette according to claim 10, wherein the actuating drive comprises a calibration lever connected with the holder, and an actuating gear being coupled with the holder.

12. The pipette according to claim 11, wherein a first scale of the indicating equipment comprises a pointer for indicating a swiveling range of the calibration lever.

13. The pipette according to claim 11, further comprising a casing including a slit and outer perimeter; the calibration lever includes an annular shaped screen that covers the slit; and the screen is stationary with respect to the cylinder and assigned to the first scale.

14. The pipette according to claim 11, wherein the actuating gear has a driven gearwheel on a perimeter of the holder, and a driving gearwheel engaging with the driven gearwheel and being manually operable.

15. The pipette according to claim 14, further comprising a casing, the casing having an opening, wherein the driving gearwheel of the actuating gear has an operation section projecting out of the casing, or is extends through the casing opening.

16. The pipette according to claim 12, further comprising a casing, the casing having a mark located on the casing, wherein the indicating equipment comprises a second scale, the second scale being read against the mark.

17. The pipette according to claim 16, wherein the second scale is visible through the casing opening.

18. The pipette according to claim 11, wherein the actuating gear is a spur wheel gear or a conical wheel gear.

19. The pipette according to claim 1, further comprising a casing; wherein connected to the casing are the plunger, the seat, the cylinder, the connection channel, the driving equipment, the upper and lower stoppers, the holder, the overstroke spring, the adjustment equipment and the indicating equipment.

20. The pipette according to claim 1, wherein the pipette is hand-held.

21. The pipette according to claim 1, wherein the pipette is manually operable.

* * * * *